US005269227A

United States Patent [19]

Warren et al.

[11] Patent Number: 5,269,227

[45] Date of Patent: Dec. 14, 1993

[54] MOTORIZED PORTABLE SYSTEM AND METHOD FOR AIDING PERSONS IN ASCENDING OR DESCENDING STAIRWAYS

[75] Inventors: Robert C. Warren, P.O. Box 671, Eastsound, Wash. 98245; Stanley E. Farmer, Battle Ground, Wash.; Glenn E. Herz, Portland, Oreg.

[73] Assignee: Robert C. Warren, Eastsound, Wash.

[21] Appl. No.: 860,971

[22] Filed: Mar. 31, 1992

[51] Int. Cl.[5] ..... B61C 11/04

[52] U.S. Cl. ..... 105/29.1; 104/89; 105/148; 187/12

[58] Field of Search ..... 104/89, 93, 94, 307; 105/26.05, 29.1, 127, 148, 150, 463.1; 187/7, 12

[56] References Cited

U.S. PATENT DOCUMENTS

| | | | |
|---|---|---|---|
| 3,336,877 | 8/1967 | O'Donnel | 104/93 X |
| 3,573,877 | 4/1971 | Locke | 280/5.32 |
| 3,592,282 | 7/1971 | Soileau | 180/8.2 |
| 3,985,082 | 10/1976 | Barac | 104/89 |
| 4,253,287 | 3/1981 | Overmoe | 52/184 |
| 4,445,502 | 5/1984 | Swan et al. | 104/89 X |
| 4,564,086 | 1/1986 | Kingston | 187/12 |
| 4,602,567 | 7/1986 | Hedström | 105/153 |
| 4,904,916 | 2/1990 | Gisske et al. | 318/649 |
| 4,913,264 | 4/1990 | Voues et al. | 187/12 |
| 5,050,708 | 9/1991 | Wood | 187/12 |
| 5,052,521 | 10/1991 | Wendt et al. | 187/12 |

FOREIGN PATENT DOCUMENTS

| | | | |
|---|---|---|---|
| 244030 | 11/1987 | European Pat. Off. | 187/12 |
| 3307488 | 9/1984 | Fed. Rep. of Germany | 104/89 |
| 8710943 | 12/1987 | Fed. Rep. of Germany . | |
| 8217206 | 1/1988 | Fed. Rep. of Germany . | |
| 3934431 | 4/1991 | Fed. Rep. of Germany . | |
| 2517287 | 6/1983 | France . | |
| 58-20271 | 2/1983 | Japan . | |
| 60-43678 | 3/1985 | Japan . | |
| 1-58584 | 4/1989 | Japan . | |
| 229760 | 9/1989 | Japan | 104/93 |
| 3-61278 | 3/1991 | Japan . | |

OTHER PUBLICATIONS

LIFTA Treppenlifte brochure (undated) published by LIFTA GmbH of Cologne, Germany.

HIRO Lift brochure (undated) published by Hillenkötter & Ronsieck GmbH of Bielefeld, Germany.

*Primary Examiner*—Robert J. Oberleitner
*Assistant Examiner*—S. Joseph Morano
*Attorney, Agent, or Firm*—Chernoff, Vilhauer, McClung & Stenzel

[57] ABSTRACT

A portable system for aiding persons in ascending or descending stairways comprises either a motorized portable upper body support assembly or a motorized vehicle for detachably drivingly engaging elongate tracks associated with different stairways. The detachability of the motorized unit from the track, combined with its portability, enables the user to employ the same portable unit interchangeably with any stairway in any location so long as the stairway is equipped with a mating track, thereby enabling an unlimited number of stairways in private or public buildings to be adapted inexpensively for use by physically impaired persons. The portable motorized unit is readily able to adapt to stairways of different slopes and configurations, and to tracks on either the right-hand or left-hand side of the stairway, so as to maximize the versatility of the portable unit for use with virtually any track-equipped stairway.

13 Claims, 8 Drawing Sheets

MOTORIZED PORTABLE SYSTEM AND METHOD FOR AIDING PERSONS IN ASCENDING OR DESCENDING STAIRWAYS

BACKGROUND OF THE INVENTION

The present invention relates to systems for aiding physically impaired persons in ascending or descending stairways. More particularly, the invention is directed to a motorized portable system which can be used transferably with a virtually unlimited number of different stairways to minimize cost, and which nevertheless is extremely safe and reliable.

The majority of previously developed systems are permanent installations. In such systems a motorized moving handgrip or a motorized supporting platform or chair is permanently mounted in conjunction with a particular stairway so that a person can walk or ride up or down the stairway with the aid of the device. A principal drawback of a permanent installation is that a separate motorized system is needed for each separate stairway, thereby maximizing the capital cost for each stairway and thus severely limiting the number and locations of stairways for which the system is usable. Systems of this general type are exemplified by the following publications:

U.S. Pat. No. 4,602,567
U.S. Pat. No. 4,904,916
U.S. Pat. No. 4,913,264
U.S. Pat. No. 5,050,708
U.S. Pat. No. 5,052,521
German Patent Publication No. DE 3934431A1
German Utility Model G8710943.3
German Utility Model G8217206.4
French Patent Publication No. 2517287
Japanese Utility Model Publication No. 60-43678
Japanese Utility Model Publication No. 1-58584
Japanese Patent Publication No. 3-61278
LIFTA Treppenlifte brochure (undated) published by LIFTA GmbH of Cologne, Germany.
HIRO LIFT brochure (undated) published by Hillenkotter & Ronsieck GmbH of Bielefeld, Germany.

Another general class of prior systems consists of free-standing stair-climbing vehicles. These units require no mounting whatsoever of hardware on each stairway, and thus possess the adaptability for use with different stairways which the permanent installations lack. However, these systems, as exemplified by U.S. Pat. Nos. 3,573,877 and 3,592,282, must depend on proper stair surface conditions and friction for adequate traction, and upon proper weight distribution for stability, neither of which is reliable from a safety standpoint. Alternatively, such systems could include their own portable tracks, as shown in U.S. Pat. No. 4,564,086, but this would severely restrict their versatility for use with different lengths and slopes of stairways.

A few systems have been conceived in the past in which an assisting device can detachably engage a stair-mounted track to provide a reliable tractive and stable interconnection with the stairway, and yet can be used transferably on other similarly tracked stairways. U.S. Pat. No. 4,253,287 shows a nonmotorized handgrip which detachably engages tracks on both sides of a stairway and thus may be portably transferred between the tracks of different stairways. However, motorizing such a handgrip in a manner consistent with its detachability from the track is highly problematic. Japanese Utility Model Publication No. 58-20271 shows a wheelchair detachably connectable to a stairway track assembly. Although the wheelchair would apparently be transferable between the respective tracks of different stairways, the wheel-chair has no mechanism for adjusting to tracks and stairways of different slopes without affecting the horizontal attitude of the wheelchair, and engagement of tracks located on different sides of respective stairways is possible only by disassembling and remounting a trackengaging pinion. Moreover, the extremely forward position of the pinion relative to the wheelchair requires that the track extend significantly beyond the top or bottom of the stairway to enable the wheelchair to be stably positioned before it is disengaged from the track. Such a track extension is impossible in the common situation where a hallway transversely intersects the top or bottom of a stairway. In addition, the track engagement pinion of the wheelchair projects permanently outwardly of the wheels thereby inhibiting the ability of the wheelchair to pass through narrow spaces.

SUMMARY OF THE INVENTION

The principal objective of the present invention is to overcome the above-described drawbacks of prior systems by providing a motorized system for aiding persons in negotiating stairways which is adaptable for use transferably with a virtually unlimited number of different stairways to avoid the high capital costs associated with permanent installations, and yet has all of the safety and reliability characteristics of a permanent installation.

The invention accomplishes this objective by providing a portable motorized upper body support assembly or motorized vehicle (depending upon the degree of physical impairment of the user) which is detachably engageable with a simple, relatively inexpensive track permanently installed in conjunction with any stairway. The portable upper body support assembly or vehicle, preferably having an integral driving motor, can be carried or otherwise transported from one track-equipped stairway to another and thereby used interchangeably in a highly versatile manner. The system is extremely cost effective because only a single, portable, transferable unit is required for each user, regardless of the number of different stairways for which the system is used. Despite its low capital cost, however, the system maximizes safety and reliability by drivingly engaging the portable unit with a permanently mounted track to prevent any chance of mishap.

The system's versatility is unrestricted by differences in lengths, slopes, and other variable features of each stairway. For example, vertical adjustability of the motorized upper body support assembly (which may consist of a handgrip, or an elbow or forearm support, etc.) adapts it for different slopes, and for either ascending or descending a stairway. The motorized vehicular unit can engage tracks having different slopes while maintaining the horizontal attitude of the unit constant due to a track-engaging device on the vehicle which assumes variable positions relative to the vehicle automatically in response to the slope of the track. Moreover, each motorized unit is readily engageable with a track whether mounted on the right-hand or left-hand side of a stairway. Despite these versatile capabilities, the width of the vehicular unit is not enlarged because the track-engaging device is selectively retractable, thereby minimizing the space requirements of the vehicle. The system is adaptable even to stairways intersected transversely by hallways at the foot or head of the stairway, because the system minimizes the length of track required to extend beyond the head or foot of the stairway. Any minimal extension of the track into a transverse hallway area is merely temporary due to the retractability of the extension portion of the track.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENTS

Portable Motorized Upper Body Support System

Figure 1:
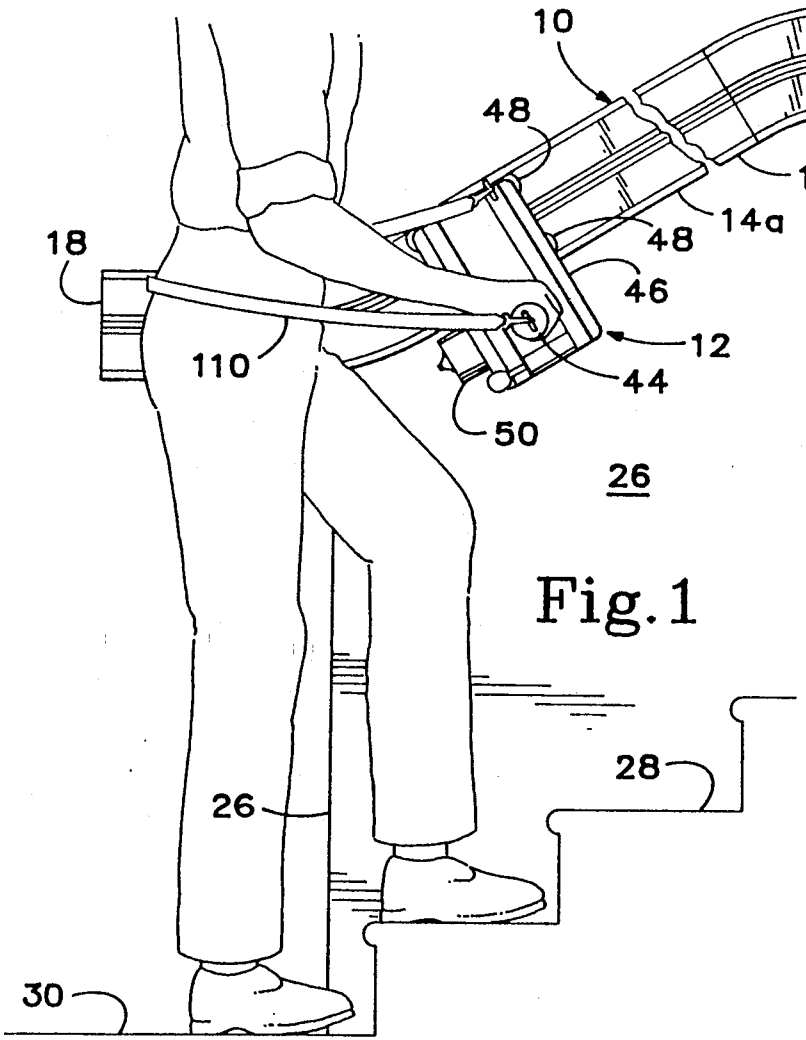
FIG. 1 is a side view of an exemplary embodiment of a motorized portable upper body support system including a handgrip in accordance with the present invention.

A preferred embodiment of a portable motorized upper body support system in accordance with the present invention is shown in FIG. 1 and comprises a track assembly, designated generally as 10, and a portable motorized handgrip assembly, designated generally as 12, for detachably drivingly engaging the track assembly. Alternative upper body support systems could include elbow, forearm or other appropriate supports instead of a handgrip.

Figure 3:
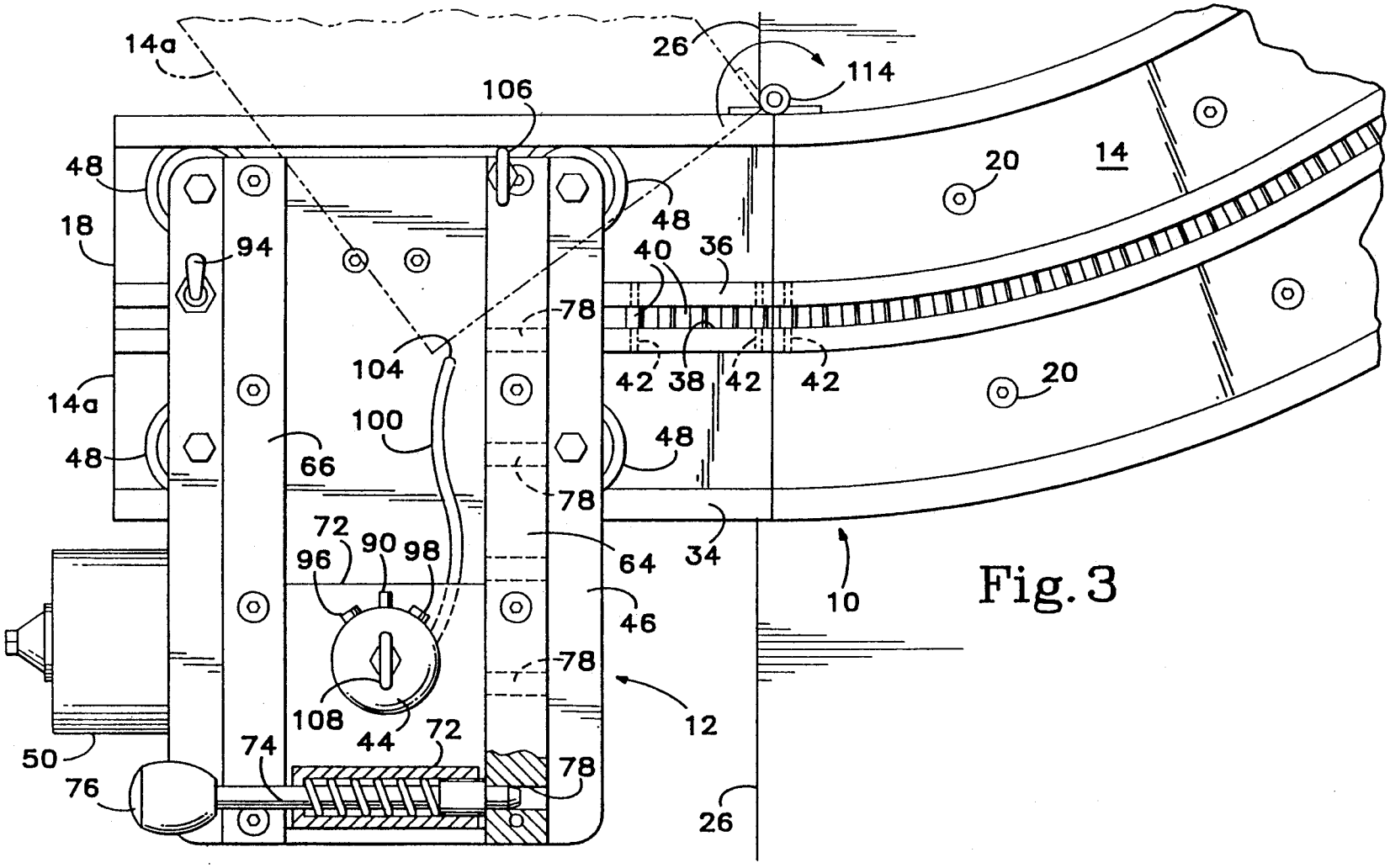
FIG. 3 is an enlarged partial side view of the system of FIG. 1.
Figures 4, 5:
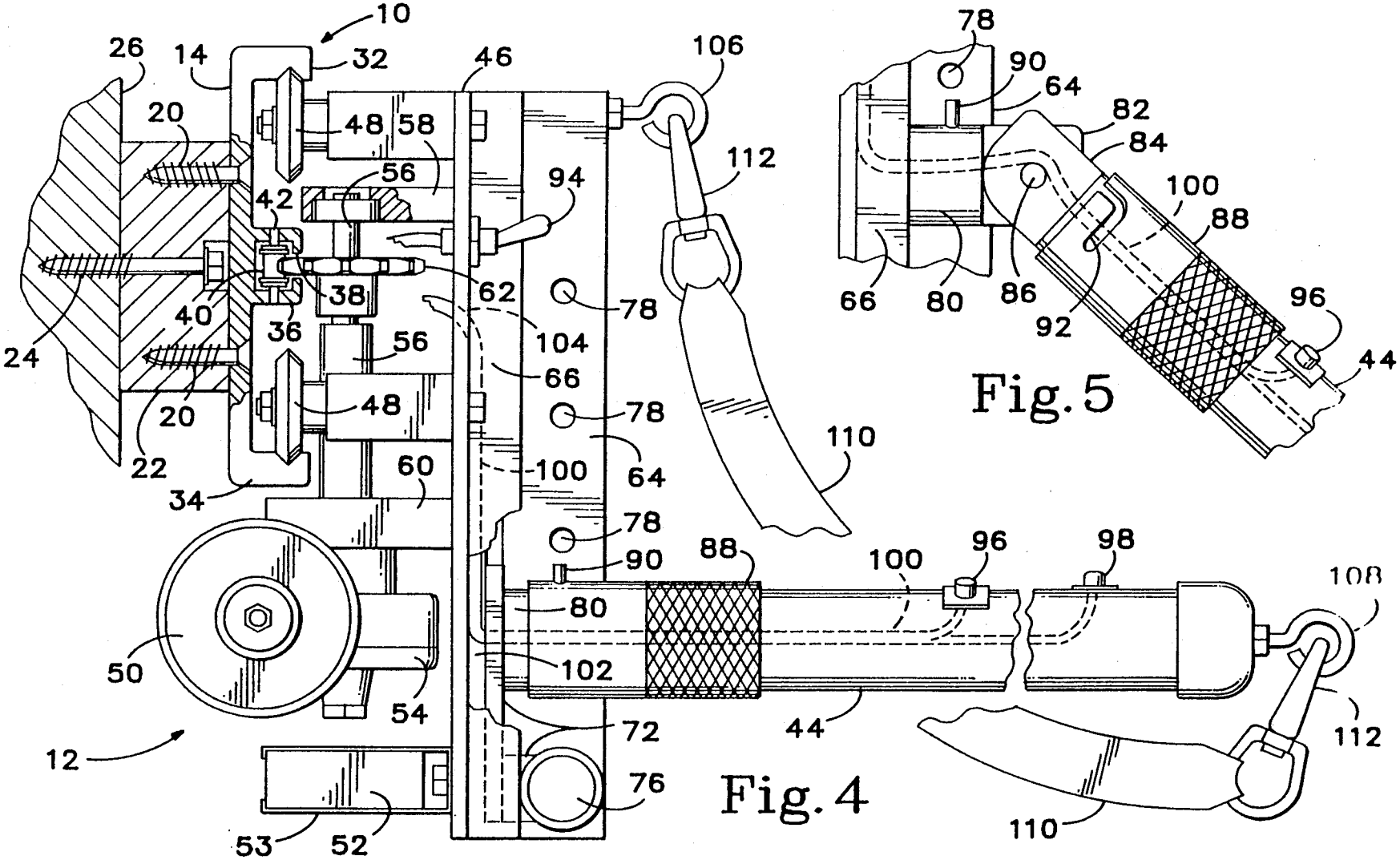
FIG. 4 is an enlarged partially sectional end view of the system of FIG. 1.
FIG. 5 is an enlarged partial end view of the system of FIG. 1 showing the handgrip in a partially retracted position.

The track assembly 10, as shown in FIGS. 1, 3 and 4, comprises an elongate metal track 14 having upper and lower ends 16 and 18. The track is fastened by screws 20 to a spacer 22 (FIG. 4) which is in turn fastened by screws such as 24 to a wall 26 alongside a stairway 28. The track 14 is fastened so as to extend longitudinally at the same slope as the stairway 28, except where the ends 16 and 18, respectively, curve gradually into a horizontal attitude in the regions above the respective landings, such as 30, at the head and foot of the stairway. The track 14 has a generally E-shaped cross-section as seen in FIG. 4, where top and bottom legs 32, 34 of the cross-section contain opposed V-grooves opening toward each other and extending continuously along the length of the track. The middle leg 36 comprises a rectangular housing having a slot 38 formed continuously along the length of the track with an elongate roller chain composed of rollers 40 extending longitudinally within the housing, the roller chain being pinned to the housing by pins such as 42. The cross-section of the track is completely open and exposed on each end 16, 18, as shown with respect to one of the ends in FIG. 4.

The track is preferably composed of straight sections such as **14*a*, 14*b* (FIG. 1) and curved sections such as 14*c***. The curved sections of the roller chain are composed of conventional "circular chain" links enabling curvature about an axis perpendicular to the link pins. If desired, the track can also include sections which permit it to curve horizontally through an angle of 180° and continue up or down an adjacent flight of stairs.

The portable handgrip assembly 12 comprises a handgrip 44 and a handgrip support 46 having four rollers 48 which supportably matingly engage the facing V-grooves formed in the legs 32 and 34 of the track 14, as shown in FIGS. 3 and 4. The handgrip support 46 further includes a bidirectional electric motor 50 powered by a rechargeable battery 52 supported removably in a housing 53. The motor 50 has a conventional worm gear drive assembly 54 with a sufficiently large mechanical advantage that it can only be driven by the motor and cannot drive the motor. The drive assembly 54 drives a shaft 56, journaled in upper and lower supports 58 and 60, which drives a sprocket 62 affixed thereto. The teeth of the sprocket 62 mesh matingly with the rollers 40 of the roller chain through the elongate slot 38 as shown in FIG. 4.

The handgrip support 46 also includes a pair of vertical guides 64, 66 having oppositely facing channels 68, 70 for slidably engaging a slide assembly 72 to enable vertical reciprocation of the slide assembly. Supported in cantilevered fashion by the slide assembly 72 in a direction transverse to the longitudinal direction of the track 14 is the handgrip 44. Also carried by the slide assembly 72 is a spring-biased pin 74 with a handle 76 which permits manual retraction of the pin from respective apertures 78 formed in the guide 64, so that the slide assembly 72, together with the handgrip 44, can be adjusted vertically to different fixed positions with respect to the handgrip support 46, and thus with respect to the track 14 when the handgrip support and track are engaged with each other. This vertical adjustability enables the handgrip 44 to be adjusted not only to accommodate the height of the user but also to accommodate stair-descending versus stair-ascending usage. The latter requirement arises because the user may need the handgrip 44 to be at a higher elevation relative to the track when descending a stairway than when ascending it.

Figure 2:
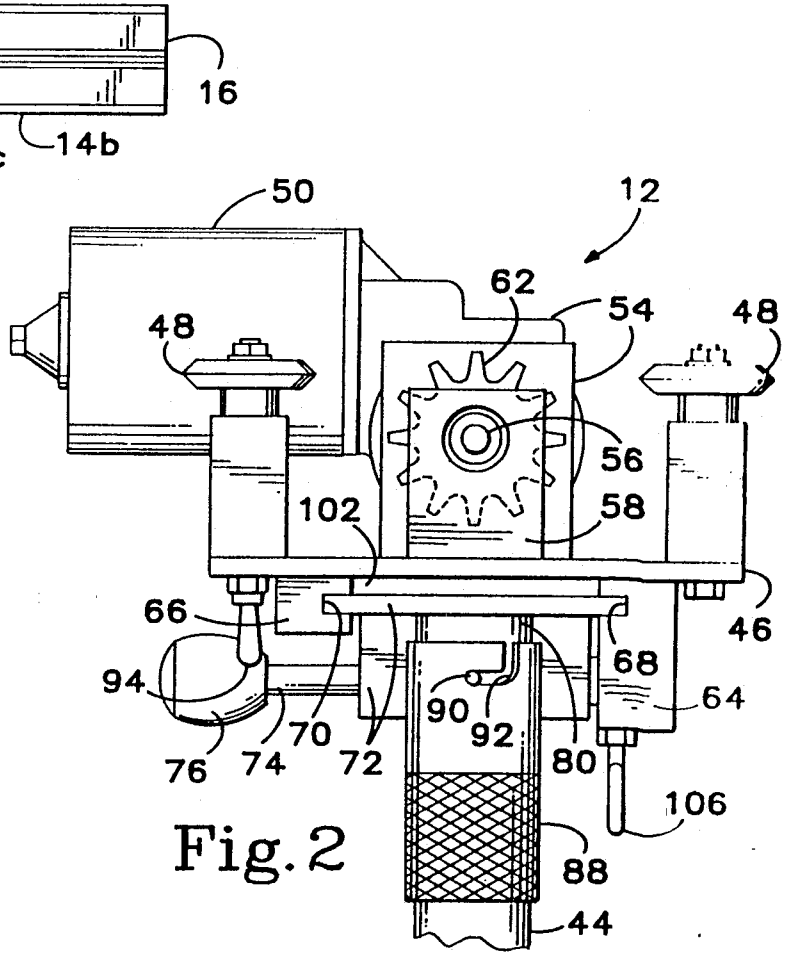
FIG. 2 is an enlarged partial top view of the system of FIG. 1.

The cantilevered support for the handgrip 44 is composed of a round, tubular stub shaft 80 on the slide assembly 72 having a centrally located clevis 82 extending therefrom. The clevis 82 is sandwiched between the legs of another clevis 84 affixed to the handgrip 44, the clevis 84 being pivotally connected to the clevis 82 by means of a pin 86. A sleeve 88 slidably and rotatably surrounds the handgrip 44 so that, when the sleeve is in a position as shown in FIG. 5, the handgrip 44 may be pivoted downwardly to retract it from its normally cantilevered position and thereby enable free passage up and down the stairway even though the handgrip assembly is engaged with the track. To return the handgrip 44 to its normal cantilevered position as shown in FIG. 4, the handgrip is simply pivoted upwardly about the pin 86 until it is coaxial with the shaft 80 and the sleeve 88 is slid over the clevises 82 and 84 past the pivot pin 86 until a pin 90 on the shaft 80 is engaged by a locking slot 92 on the sleeve. Then the sleeve is twisted to its o locked position as shown in FIG. 2, thereby firmly supporting the handgrip 44 in its cantilevered position.

A conventional three-position electrical toggle switch 94 allows the user to select high or low speeds of operation of the motor 50, while a pair of spring-biased push button switches 96 and 98 on the handgrip 44 enable the operator to select the proper direction of rotation of the reversible motor 50 and activate it by pushing the button nearest to the user. The toggle switch 94 also has an OFF position which prevents activation of the motor despite any accidental pressing of a button switch 96 or 98, for example, when the handgrip assembly is being carried by the user. An electrical conduit 100 extending from the switches 96 and 98 passes through the center of the handgrip 44 and through the central space of the clevis 82 over the pin 86 as shown in FIG. 5, and thence through the hollow center of the tubular shaft 80 into a space 102 at the back of the slide assembly 72 from which the conduit passes through an aperture 104 to the motor 50. This routing of the conduit 100 enables both the pivotal downward movement of the handgrip 44 about the pin 86, and the vertical adjustability of the handgrip 44 by movement of the slide assembly 72, in a manner compatible with the presence of the conduit 100. The remainder of the motor control circuitry is conventional.

An eyebolt 106 connected to the handgrip support 46, and another eyebolt 108 connected to the outer end of the handgrip 44, enable a strap 110 to be detachably fastened by conventional spring clips 112 to the portable handgrip assembly for purposes of connecting the handgrip assembly to the user independently of any manual gripping of the assembly by the user. This serves two purposes: first, if the user loses his grip on the assembly for any reason while ascending or descending a stairway, the strap prevents the user from falling down the stairway; second, the strap may be slung over the shoulder of the user after the user has detached the handgrip assembly 12 from the track 14 to enable him to transport the assembly more easily to another location.

The open-ended configuration of the track 14, coupled with the fact that the roller chain contained within the slotted housing 36 of the track does not extend completely to either end of the track as exemplified by FIG. 3 with respect to the end 18, make it feasible to use the handgrip assembly 12 transferably with different tracks 14 associated with different stairways. Because of its easy portability, the handgrip assembly 12 can be carried to either end of the track 14 and the rollers 48 detachably engaged supportably in the opposing V-grooves of the legs 32 and 34 by sliding the handgrip assembly through the end of the track to a position such as shown in FIG. 3. This can be done without the necessity of simultaneously engaging the drive sprocket 62 with the roller chain and actuating the motor, which would be difficult to coordinate. Instead, the V-grooves are able to provide initial engagement, support and alignment of the handgrip assembly with the track. After this has been accomplished, the user need only push the handgrip assembly slightly further along the track to achieve automatically aligned engagement of the drive sprocket 62 with the recessed end of the roller chain.

After connecting the strap 110 around his waist as depicted in FIG. 1, the user can press the appropriate button switch 96 or 98 and begin to ascend or descend the stairway while gripping the handgrip assembly. In the course of negotiating the stairway, the user may move the handgrip assembly in increments along the track by intermittently releasing the button switch to stop the progress of the handgrip while the user prepares for his next step. Whenever the button switch is released, the handgrip assembly is effectively locked to the track by the above-described worm gear drive assembly 54 (or any other equivalent drive structure which prevents the handgrip assembly from moving along the track when the motor is deactivated). The user may also find it useful to intermittently press the other button switch to reverse the direction of the handgrip assembly momentarily to properly position it for his next step, such as when he has inadvertently moved it too far ahead for his next step.

At the opposite end of the track the drive sprocket 62 will automatically disengage from the roller chain before the rollers 48 cease to support the handgrip assembly on the track, again because of the recessed, inward location of the end of the roller chain relative to the end of the track. Thus it is impossible for the drive sprocket 62 to drive the handgrip assembly accidentally off the end of the track before the user is ready to detach it and carry it away. Rather, the user is assured that he will have time to stop, detach the strap 110 from his waist, and reposition the strap over his shoulder if he wishes, before he disengages the handgrip assembly from the track by sliding it out the open end. He may then carry it to another stairway having a similar track and repeat the foregoing procedure.

In some applications the foot or head of a particular stairway is intersected transversely by a hallway, so that the wall 26 ends abruptly as shown in FIGS. 1 and 3. This makes it impossible for the track 14 to extend permanently beyond the wall 26 above the landing 30. However, in such applications the t rack 14 can include a hinged extension portion **14*a* as shown in FIG. 3 which the user can temporarily extend into the hallway when needed and then retractably pivot upwardly and rearwardly about the hinge 114 when not in use. The roller chain can extend through the hinged joint by using a two-section chain with pins 42** on each side of the joint at positions which maintain the normal roller spacing across the joint.

It is preferred, for reasons of economy, that the drive motor 50 be mounted on the portable handgrip assembly 12 or other upper body support assembly as shown in the drawings. However, the provision of a motor-driven continuous roller chain on the track assembly 10, trained around respective motor-driven and idler sprockets near the respective ends of the track and detachably engageable and disengageable by fixed teeth on a portable upper body support assembly, could be feasible for at least some applications and is therefore within the scope of the present invention. In such an application the driven continuous roller chain would be turned axially 90 degrees from the orientation shown in the drawings, and would be engaged by fixed teeth on the portable assembly from above or below the roller chain rather than horizontally as in the drawings. Alternatively, the handgrip 44 or comparable upper body support member could detachably engage a motorized trolley which is driven along the track and is a permanent part of the track.

Power for any version of the portable upper body support system can be supplied by a battery or batteries carried on or in the portable assembly, as shown, or carried separately by the user in a vest or other convenient holder. Alternatively, if desired, the track assembly can include an AC or transformed DC power source with conductors along the length of the track which slidably or otherwise detachably engage contacts on the portable unit to complete circuits through the control switches and/or motor carried by the portable unit. The latter alternative subtracts the weight of the battery from the portable unit and avoids any possibility of a depleted power source, but adds cost to the original installation.

The handgrip 44 can take forms other than the transverse bar shown in the drawings. For example, a handgrip resembling a bicycle handlebar with grips on each end could be supported by the handgrip support 46 in an orientation either transverse to the track or parallel to the track (the latter for persons preferring to negotiate the stairway by side-stepping). The handgrip assembly could also include ground-engaging elements if desired such as a depending shaft enabling the assembly to serve as a cane for the user when detached from the track, or multiple depending shafts enabling the assembly to serve as a walker.

Vehicular Systems

For those situations where a person's physical impairment is such that a vehicle, such as a wheeled walker, wheelchair, or three- or four-wheeled scooter is needed for movement over level surfaces, the upper body support assembly of the previous embodiment is replaced by such a vehicle equipped with a motorized track-engaging device detachably engageable and disengageable interchangeably with different track assemblies mounted alongside different stairways. In the embodiments to be described hereafter, the preferred track assembly is of a different configuration than that previously described for use with the portable upper body support assembly. However, both an upper body support assembly and vehicle could be equipped with compatible track-engaging devices and thus used interchangeably with a single track configuration, which would be desirable for institutional or public usage.

Figure 6:
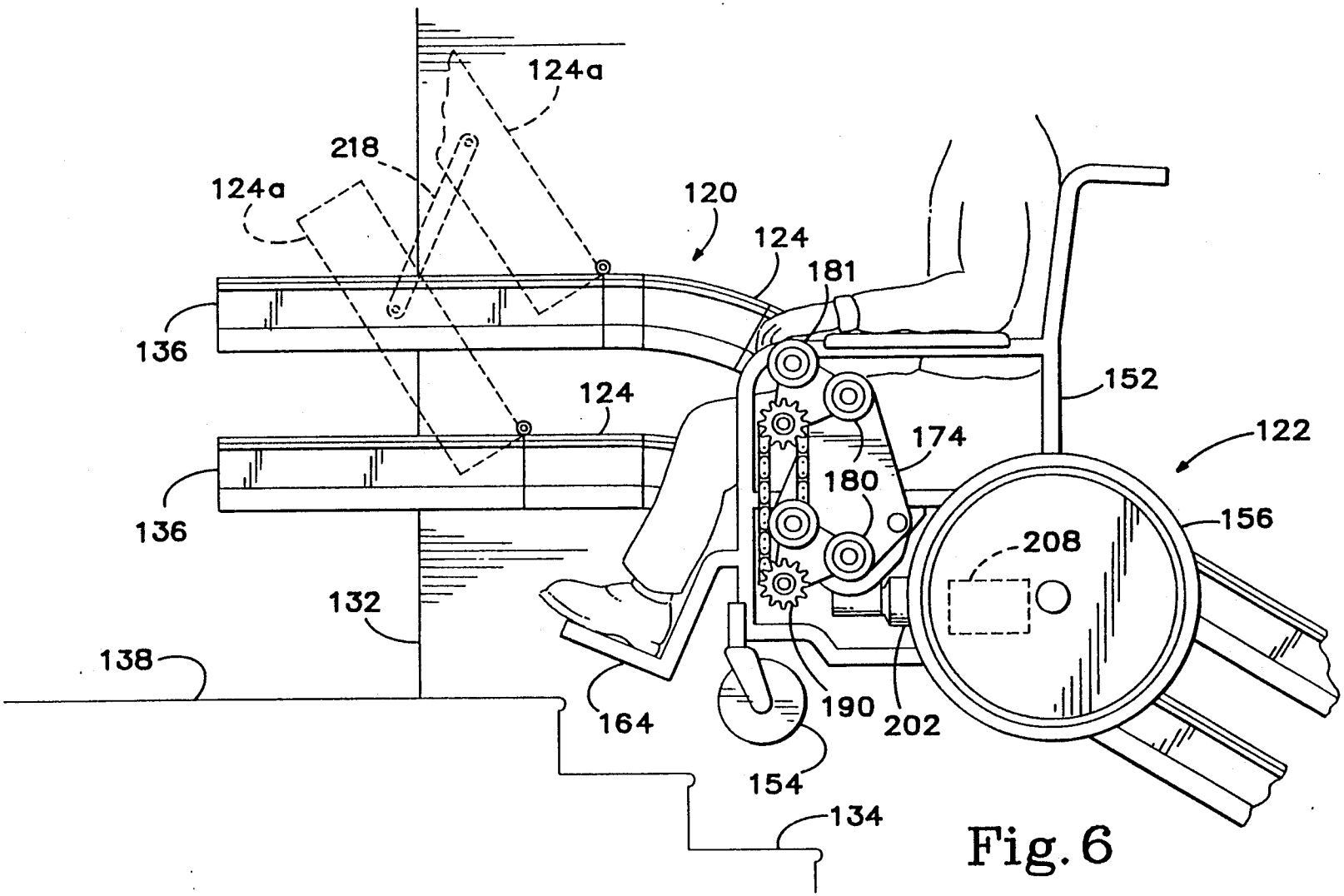
FIG. 6 is a side view of an exemplary embodiment of a motorized vehicle system in accordance with the present invention.

FIG. 6 shows an embodiment of a vehicular system in accordance with the present invention which comprises a two-part track assembly 120, and a vehicle comprising a specially modified wheelchair 122 for detachably drivingly engaging the track assembly.

Figure 8:
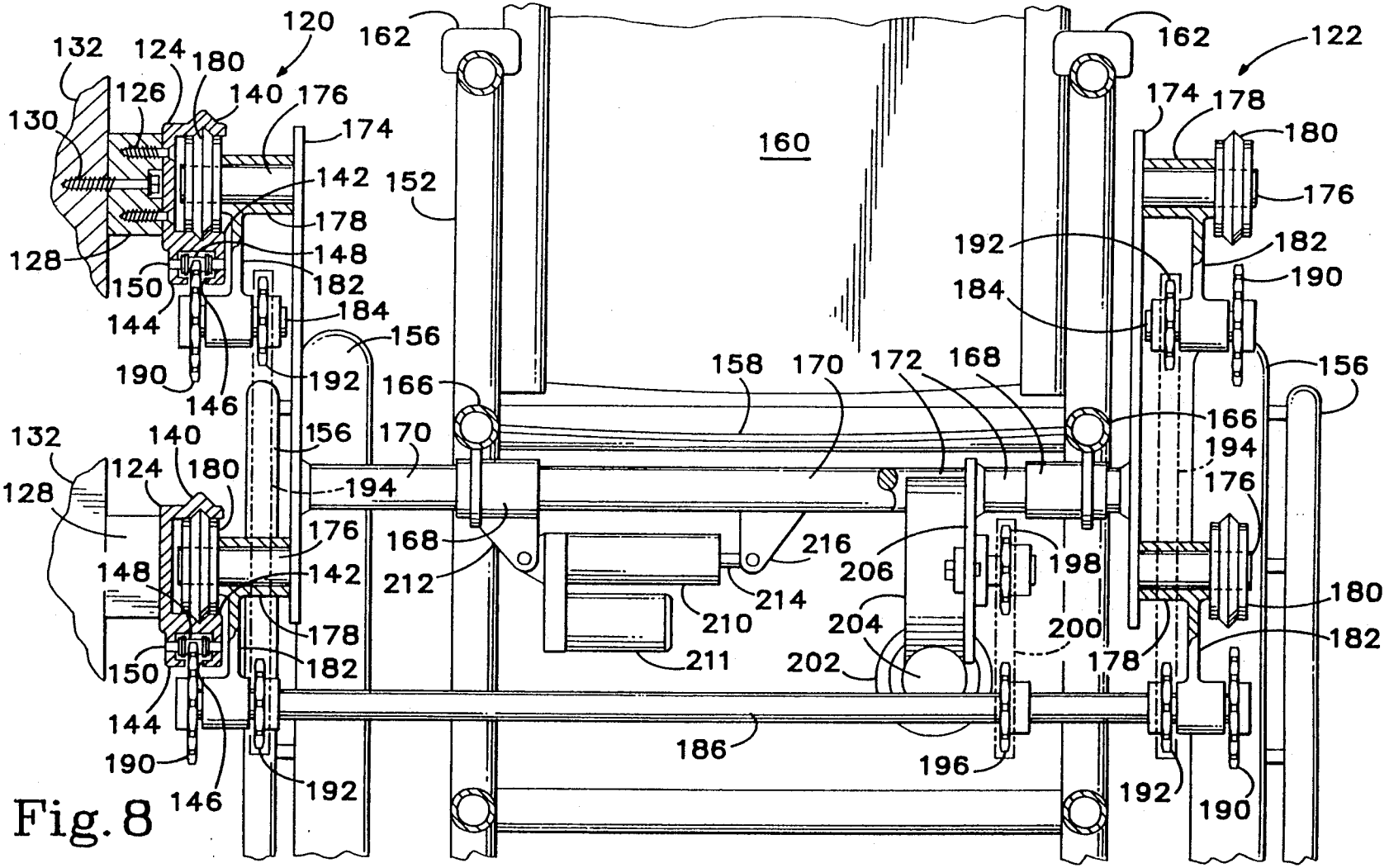
FIG. 8 is an enlarged partially sectional end view of the system of FIG. 6.

The track assembly 120 comprises a pair of elongate metal tracks 124, each having upper and lower ends and each fastened by screws 126 to a spacer 128 (FIG. 8) which is in turn fastened by screws such as 130 to a wall 132 alongside a stairway 134. Both tracks 124 are fastened so as to extend longitudinally at the same slope as the stairway 134, except where the ends such as 136 assume a horizontal attitude above the respective landings, such as 138, at the head and foot of the stairway. Each of the tracks 124 has a generally C-shaped cross section as seen in FIG. 8, where top and bottom legs 140, 142 of the cross section contain opposed V-grooves opening toward each other and extending continuously along the length of the track. Below the leg 142 of each track is a rectangular housing 144 having a slot 146 formed in the bottom thereof extending along the length of the track. An elongate roller chain 148 extends longitudinally within the housing, the roller chain being fastened to the housing by pins such as 150 at the ends of the chain. The cross section of the track is completely open and exposed on each end for detachable engagement and disengagement by the wheelchair 122.

Preferably, the tracks are sectioned into straight and curved portions as described previously with respect to the portable handgrip system. If it is desired that the tracks curve horizontally through an angle of 180° to continue up or down an adjacent flight of stairs, this can be accomplished either with "circular chain" links or by orienting the chain and drive sprockets similarly to the orientation shown with respect to the portable handgrip system, in combination with appropriately curved cast track sections.

The wheelchair 122 is composed of a frame 152 supported in a conventional manner by front casters 154 and rear drive wheels 156. The frame 152 conventionally includes a seat 158, back 160, arm rests 162 and foot rest 164. Suspended from each of a pair of horizontal frame members 166 are a respective pair of tubular slide guides 168 having respective front and rear transverse slides 170, 172 mounted therein so as to reciprocate slideably along a direction transverse to the direction of travel of the wheelchair. On the opposite ends of the slides 170, 172 respective plates 174 are affixed. Protruding outwardly from each plate 174 is a respective pair of shafts 176, upon each of which is journaled a respective rotatable sleeve 178 and a respective roller 180 mateable with the V-grooves in the legs 140, 142 of the tracks 124. Each rotatable sleeve 178 has a respective web 182 affixed thereto to which are journaled a respective further roller 181 identical to rollers 180 and a respective sprocket shaft 184 or 186 as the case may be. The axes of the rollers 181, and the axes of the sprocket shafts 184 and 186, are thus pivotal about the respective shafts 176 upon which their respective sleeves 178 and webs 182 are mounted as indicated, for example, by the directional arrow 188 in FIG. 7. The sprocket shaft 186 traverses between the respective lower webs 182 on each side of the wheelchair, while the respective sprocket shafts 184 are rotatably mounted separately in the upper webs 182 as shown in FIG. 8. Fixedly mounted on the outer extremities of the respective sprocket shafts 184 and 186 are drive sprockets 190 mateable through the slots 146 with the roller chains 148 of the track assembly. Inwardly mounted sprockets 192, also affixed to the respective sprocket shafts 184 and 186, interconnect the lower sprocket shaft 186 and upper sprocket shafts 184 through respective chains 194 so that the shaft 186 is able to drive all upper and lower drive sprockets 190 in unison. The shaft 186, in turn, is driven through sprocket 196 and chain 200 by a sprocket 198 which is coaxial with the shafts 176 upon which the lower webs 182 are pivotally mounted. Thus, the distance between sprockets 196 and 198 remains constant even though the sprocket shaft 186 pivots about the lower shafts 176. Sprocket 198 is driven by a reversible multispeed electric motor 202 through a worm gear assembly 204 similar to that described previously with respect to the portable handgrip assembly. The motor 202, worm gear assembly 204 and sprocket 198 are all suspended from the rear slide member 172 by a bracket 206. The motor 202 is powered by a battery 208 through control switches (not shown) mounted on the wheelchair which function similarly to those described previously with respect to the portable handgrip assembly.

The pivotability of the axes of the drive sprockets 190 and rollers 181 about the axes of the respective shafts 176 maintains the wheelchair at a constant attitude with respect to horizontal while moving along the track assembly regardless of the slope of the track assembly. For example, if the slope of the track assembly increases, the respective webs 182 pivot in a clockwise direction about the respective shafts 176 while the chains 194 ensure that the upper and lower drive sprockets 190 rotate in unison and thus maintain their vertically-aligned relationship on the tracks 124. This in turn ensures that the shafts 176 likewise maintain their vertical relationship and thus that the wheelchair retains its horizontal attitude as the slope of the track assembly changes. This arrangement also has the advantage of enabling the rollers 181 to adjust pivotally to any difference in height between the track assembly and the rollers during the track-engaging process, such differences in height possibly occurring due to such variables as wear of the wheels 154, 156 or wear of the floor in the landing area.

Different equivalent arrangements of drive sprockets and rollers will achieve substantially the same results with different track configurations. Basically all that is necessary to achieve the automatic adaptability to different track slopes while maintaining a horizontal attitude are variable-position rollers or variable-position drive sprockets whose axes are capable of moving to different vertical positions, relative to some other track-engaging member on the vehicle, automatically in response to the slope of the track. All such automatically self-adjusting arrangements are considered to be within the scope of this particular inventive feature of the system.

A conventional double-acting electrically powered ballscrew linear actuator 210 has its housing fixedly mounted by means of a bracket 212 to a rear slide guide 168, while its shaft 214 is connected by another bracket 216 to the rear slide member 172. The actuator 210 has a reversible electric motor 211 which drives the shaft 214 to selectively either retract or extend the shaft from a central neutral position when the actuator is energized, depending on the direction selected. Thus, by retracting the shaft 214, the rear slide member 172 extends the plate 174 on one side of the wheelchair transversely outwardly of the wheels 156 so as to engage the track assembly as shown in FIG. 8. Conversely, by extension of the shaft 214, the plate 174 on the opposite side of the wheelchair can be extended for track engagement while retracting the opposite plate 174. At the central neutral position of the actuator 210, the trackengaging devices on each side of the wheelchair are within the outer profile of the wheels 156 so that the track-engaging devices do not, during normal operation of the wheelchair on level surfaces, widen its profile. Thus, the wheelchair retains the same ability to pass through narrow spaces as if no track-engaging devices were provided. Because the motor 202 and worm gear assembly 204 are mounted on the rear slide member 172, they likewise move transversely in unison with the trackengaging devices.

The wheels 156 can be driven by a separate motor (not shown). Alternatively, the sprocket 198 can be slidably connected to another drive sprocket which drives the wheels 156 through a separate chain and sprocket arrangement so that the motor 202 also drives the wheels 156. Any such drive connection between the motor 202 and the wheels 156 should also include an overrunning clutch allowing the wheelchair to coast when the motor 202 is deactivated since the worm gear assembly 204, as in the portable handgrip assembly, has a high mechanical advantage preventing the wheels 156 from driving the motor.

Figure 7:
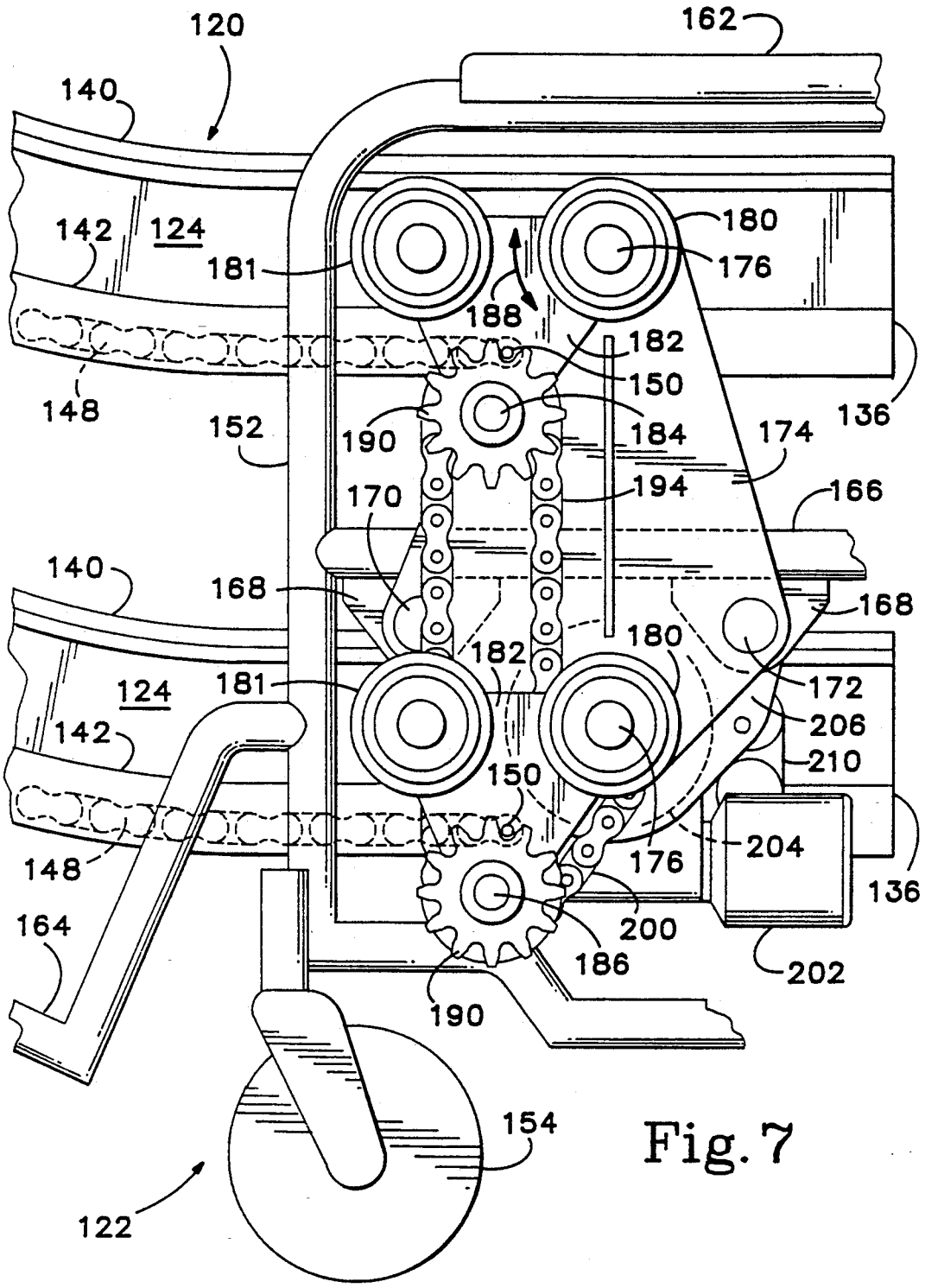
FIG. 7 is an enlarged partial side view of the system of FIG. 6.

As in the portable handgrip system, the roller chains 148 are recessed with respect to the ends 136 of the tracks 124 as shown in FIG. 7 so that, when engaging the wheelchair with the track assembly, the vehicle first engages the tracks only with the rollers 180 and 181 and thereafter detachably engages the motor-driven sprockets 190 with the roller chains 148. This provides substantially the same automatic sprocket alignment and disengagement advantages previously discussed with respect to the portable handgrip assembly. Upon engagement of the drive sprockets 190 with the chain 148, the motor 202 is activated by the user and the wheelchair is driven up the tracks 124 supported in a horizontal attitude by the rollers 180 and 181. At the opposite end of the track the drive sprockets 190 disengage from the roller chains 148 before the rollers 180, 181 have become disengaged from the track, at which time the wheels 156 should be in contact with the landing and can be turned to drive the wheelchair forward off the ends of the tracks.

Also, as in the previous portable handgrip embodiment, the ends of the tracks may be hinged for selective extension and retraction as illustrated at **124*a* in FIG. 6 for those instances where a transverse hallway intersects the foot or head of a stairway. If desired, a pivotal link such as 218 can interconnect the back surfaces of the hinged track portions 124*a* to enable them to be easily extended and retracted in unison. Conventional shock-absorbing spring assemblies (not shown) can also be used to facilitate the hinged movement of the track portions 124*a***.

After disengagement from the tracks 124, the vehicle may travel in its customary manner to another stairway and engage a comparable track assembly even though the track assembly and stairway have a different slope than that of the previous stairway and track assembly. Between track engagements, the track-engaging devices of the vehicle are retracted within the profile of the wheels 156, and then extended to one side or the other by the actuator 210 only when approaching a stairway preparatory to engaging the track assembly.

Figure 9:
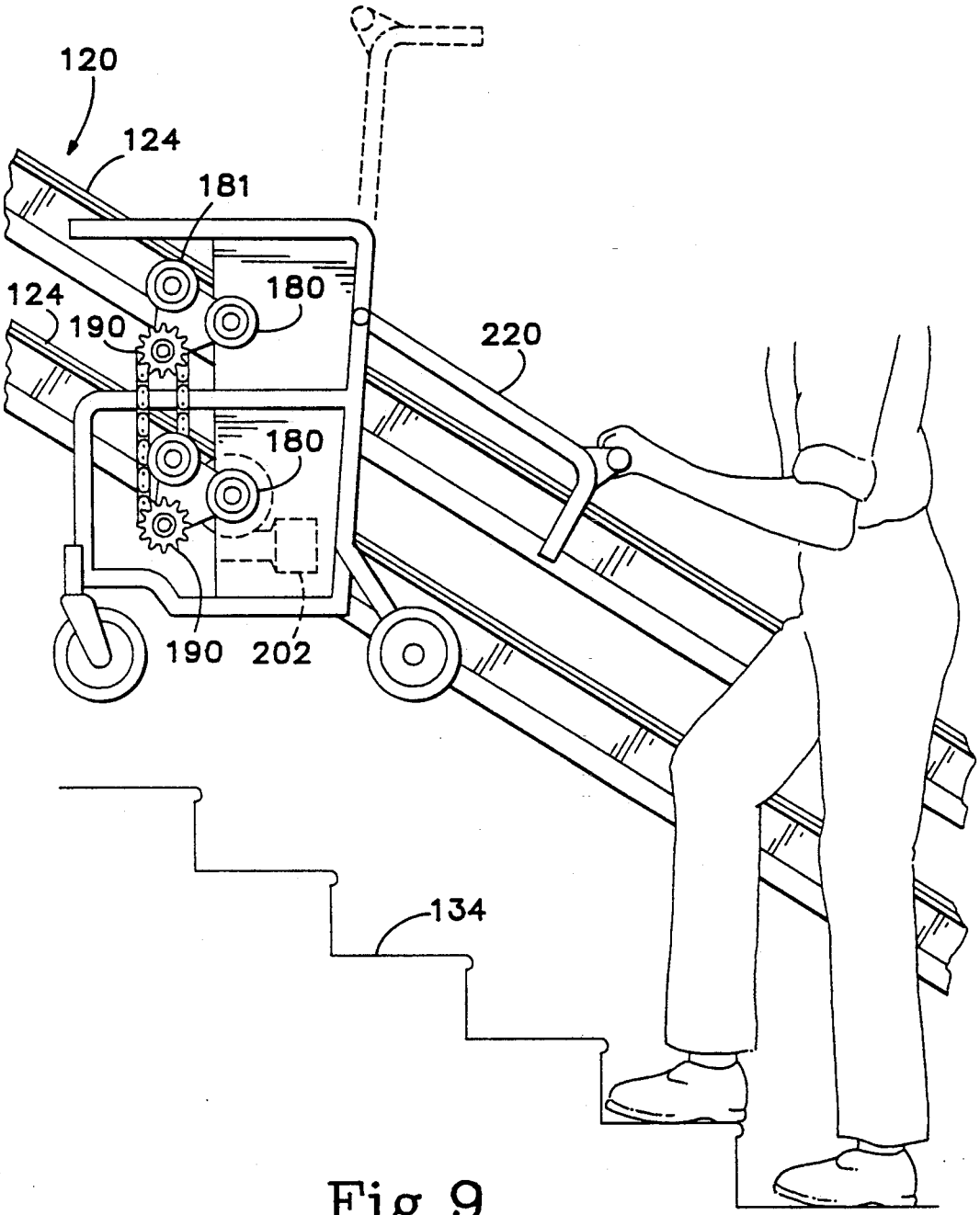
FIG. 9 is a side view of a further exemplary embodiment of a motorized vehicle system.
Figure 10:
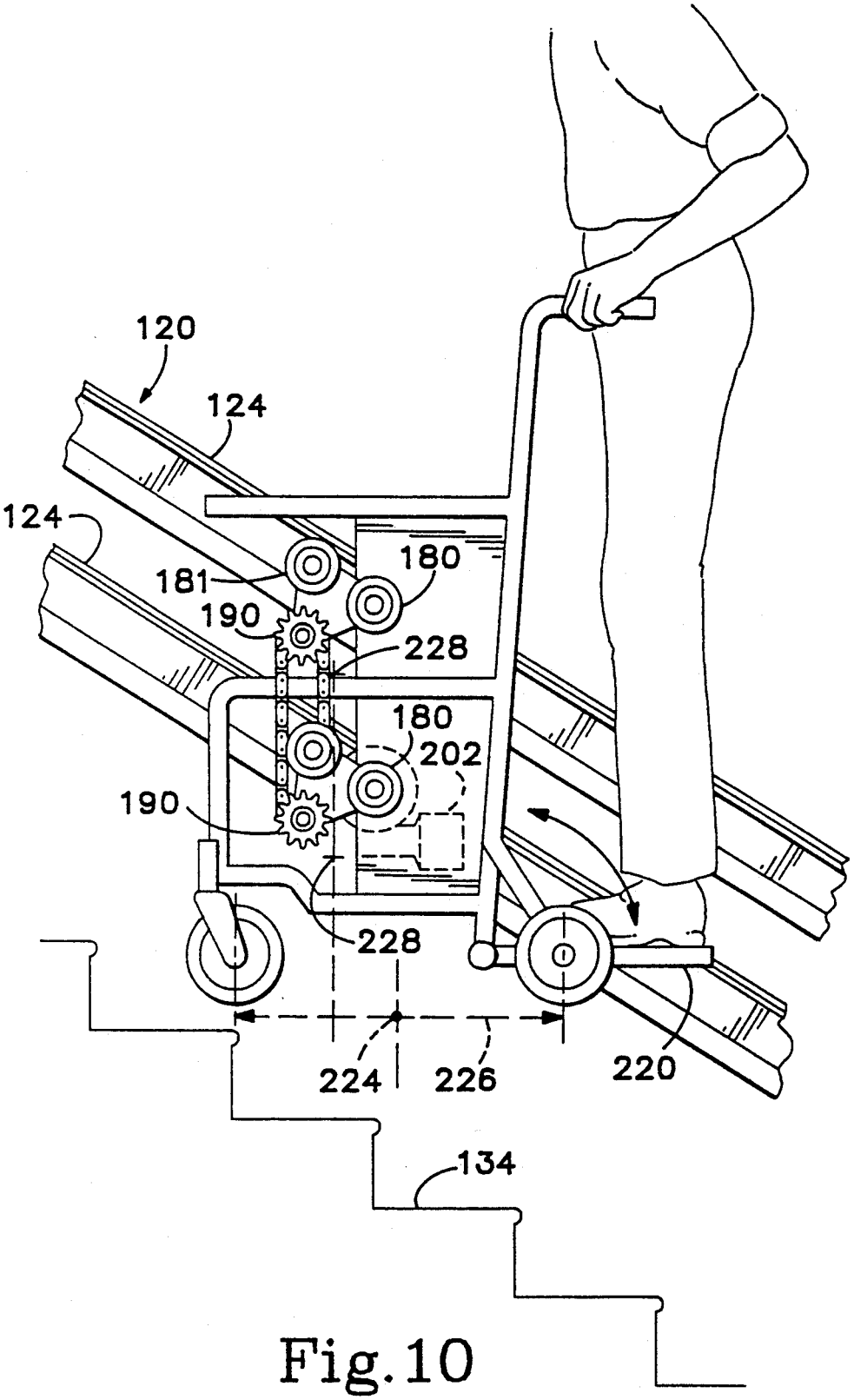
FIG. 10 is a side view of a still further exemplary embodiment of a motorized vehicle system.

FIGS. 9 and 10 show alternative exemplary types of vehicles which can be employed in the present system for negotiating the same stairway 134 equipped with the same track assembly 120. Each vehicle contains the same track-engaging devices as shown in FIGS. 6–8, with track-engaging rollers 180 and 181 and drive sprockets 190 driven by a motor 202. The vehicle of FIG. 9 is a wheeled walker having a handle 220 pivotal between a raised position, for operation on level surfaces and for descending a stairway, and a lowered position for ascending a stairway. The vehicle of FIG. 10 is another wheeled walker having a downwardly pivotal platform 220 upon which the user can stand when ascending or descending a stairway.

Because the ends of the tracks must extend horizontally over the landings at either end of the stairway in order to enable the vehicle to engage the tracks while on one landing and be deposited on the other landing prior to disengagement from the tracks, it is desirable that the drive sprockets 190, at least when engaging horizontal track sections, have axes located rearwardly of the location where the forward wheels of the vehicle engage the ground. This will tend to lessen the amount of extension of the tracks which is required over the landings. Preferably, in order to minimize the necessary track extension over the landings, the axes 228 (FIG. 10) of the drive sprockets 190, when engaging a horizontal track section, should be located as near as possible horizontally to the midpoint 224 of the distance 226 separating the forward and rearward ground-engaging points of the front and rear wheels. Such mid-positioning may be difficult to obtain on a wheelchair such as that shown in FIG. 6 because of the large diameter of the rear wheel which causes the drive sprockets to be positioned more forwardly. With other types of vehicles, however, such as those shown in FIGS. 9 and 10, or with a three- or four-wheeled scooter, the much smaller diameters of the rear wheels makes it feasible to position the axes of the drive sprockets 190 horizontally nearer to such midpoint than to the forward or rearward ground-engaging points of the wheels.

Like the portable upper body support systems, the track-engaging devices of any of the above-described vehicles may derive their power from a battery or batteries carried by the vehicle. Alternatively, they can obtain their power from an AC or transformed DC power source on the track assembly having conductors along the length of the track which slidably detachably engage contacts on the vehicle to complete circuits through the control switches and motor carried by the vehicle. Obviously, any vehicle having driven wheels, such as an electrically powered wheelchair or scooter, will carry its own battery. However, even for such vehicles, an electrically powered track has the advantage of avoiding any possibility of a depleted power source when negotiating stairways.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for assisting a person in walking up or down a stairway with the air of a portable upper body support assembly, said apparatus comprising:

(a) an elongate track, having two ends, adapted to slope longitudinally along said stairway;

(b) a portable upper body support assembly, comprising an upper body support member, capable of being carried by said person and having means for supporting said support member on said track in a position extending from said track;

(c) motor means for driving said support assembly along said track; and (d) engagement means on said track for selectively detachably engaging and disengaging said support assembly with respect to at least one end of said track, and for selectively detachably engaging and disengaging said motor means drivingly with respect to one of said track and support assembly at said one end of said track, wherein said one end of said track is an open section so as to enable said support assembly to be easily moved detachably onto and off of said one end of said track and carried transferably to and from said one end.

2. The apparatus of claim 1 wherein said motor means include a motor mounted on said portable upper body support assembly, and said engagement means include means for selectively detachably engaging and disengaging said motor means drivingly with respect to said track.

3. The apparatus of claim 2 wherein said engagement means include means for detachably engaging said portable upper body support assembly with said track prior to detachably engaging said motor means drivingly with respect to said track.

4. The apparatus of claim 1, including means on said portable upper body support assembly for detachably connecting said support assembly to said person independently of any manual gripping of the support assembly by said person.

5. The apparatus of claim 1, including means for adjustably positioning said upper body support member vertically with respect to said track when said support member is supported on said track.

6. The apparatus of claim 1 wherein said portable upper body support assembly includes means for selectively enabling retraction of said support member from said position extending from said track when said support member is supported on said track.

7. The apparatus of claim 1 wherein said track has means located at least at one end of said track for selectively extending and retracting said track longitudinally.

8. A method of walking up or down a stairway using a portable upper body support assembly, said method comprising:

(a) providing an elongate track sloping longitudinally along said stairway, said track having an upper and a lower end;

(b) providing a portable upper body support assembly, and a motor for driving said support assembly along said track;

(c) carrying said support assembly to one end of said track and engaging said support assembly with said track at said one end;

(d) actuating said motor and thereby driving said support assembly along said track while walking along said stairway and supporting the upper body on said support assembly; and (e) disengaging said support assembly from said track and carrying said support assembly away from said track.

9. The method of claim 8 wherein step (c) further includes carrying said motor to said one end of said track as part of said portable upper body support assembly and detachably engaging said motor drivingly with said track at said one end, and wherein step (e) further includes disengaging said motor from said track and carrying said motor away from said track as part of said support assembly.

10. The method of claim 9 wherein step (c) includes engaging said upper body support assembly with said track prior to detachably engaging said motor drivingly with said track.

11. The method of claim 8, further including retractably extending said track longitudinally at least at said one end thereof.

12. A method of walking up or down a stairway using a portable upper body support assembly, said method comprising:

(a) providing an elongate track sloping longitudinally along said stairway, said track having an upper and a lower end;

(b) providing a portable upper body support assembly, and a motor for driving said support assembly along said track;

(c) carrying said support assembly to one end of said track and engaging said support assembly with said track at said one end;

(d) actuating said motor and thereby driving said support assembly along said track toward the other end of said track while waling along said stairway and supporting the upper body on said support assembly; and (e) disengaging said support assembly from said track at the other end of said track and carrying said support assembly away from said other end;

(f) wherein step (c) further includes carrying said motor to said one end of said track as part of said portable upper body support assembly and detachably engaging said motor drivingly with said track at said one end, and wherein step (e) further includes disengaging said motor from said track at the other end of said track and carrying said motor away from said other end as part of said support assembly.

13. The method of claim 12 wherein step (c) includes engaging said upper body support assembly with said track prior to detachably engaging said motor drivingly with said track.

* * * * *

UNITED STATES PATENT AND TRADEMARK OFFICE

CERTIFICATE OF CORRECTION

PATENT NO. : 5,269,227

DATED : December 14, 1993

INVENTOR(S) : Robert C. Warren et al.

It is certified that error appears in the above-identified patent and that said Letters Patent is hereby corrected as shown below:

| | |
|---|---|
| Col. 5, line 4 | Delete "0". |
| Col. 6, line 40 | Change "t rack" to --track--. |
| Col. 9, line 51 | Change "trackengaging" to --track-engaging--. |
| Col. 9, line 61 | Change "trackengaging" to --track-engaging--. |
| Col. 11, line 45 | Change "air" to --aid--. |
| Col. 13, line 9 | Change "waling" to --walking--. |

Signed and Sealed this

Thirtieth Day of August, 1994

*Attest:*

*Attesting Officer*

Bruce Lehman

BRUCE LEHMAN

*Commissioner of Patents and Trademarks*